US008568896B2

(12) United States Patent
Kida et al.

(10) Patent No.: US 8,568,896 B2
(45) Date of Patent: Oct. 29, 2013

(54) LOW IGNITION PROPENSITY WRAPPING PAPER AND METHOD AND MACHINE OF MANUFACTURING SAME

(75) Inventors: Shinzo Kida, Tokyo (JP); Takafumi Izumiya, Tokyo (JP); Keisuke Towatari, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/479,727

(22) Filed: May 24, 2012

(65) Prior Publication Data

US 2012/0231288 A1 Sep. 13, 2012

Related U.S. Application Data

(63) Continuation of application No. PCT/JP2009/069866, filed on Nov. 25, 2009.

(51) Int. Cl.
*B32B 23/04* (2006.01)

(52) U.S. Cl.
USPC ..... 428/532; 428/537.5; 427/261; 162/139

(58) Field of Classification Search
USPC ..... 428/532, 537.5; 162/139; 427/261
See application file for complete search history.

(56) References Cited

U.S. PATENT DOCUMENTS

| | | | | |
|---|---|---|---|---|
| 6,645,605 | B2 * | 11/2003 | Hammersmith et al. | 428/198 |
| 8,241,460 | B2 * | 8/2012 | Kida et al. | 162/139 |
| 2011/0033624 | A1 * | 2/2011 | Tsutsumi et al. | 427/261 |

FOREIGN PATENT DOCUMENTS

| | | | |
|---|---|---|---|
| EP | 2 000 589 | A2 | 12/2008 |
| EP | 2 100 524 | A1 | 9/2009 |
| JP | 10-513234 | A | 12/1998 |
| JP | 2004-512849 | A | 4/2004 |
| JP | 2005-514939 | A | 5/2005 |
| JP | 2008-115514 | A | 5/2008 |
| JP | 2009-504174 | A | 2/2009 |
| WO | WO 2007/119484 | A1 | 10/2007 |
| WO | WO 2008/072523 | A1 | 6/2008 |

OTHER PUBLICATIONS

B.E. Ryabchikov, "Modem Methods of Water Purification for Industrial and Household Use", Moscow, DeLi Press, 2004; p. 153, 164-D3.

* cited by examiner

*Primary Examiner* — Leszek Kiliman

(74) *Attorney, Agent, or Firm* — Birch, Stewart, Kolasch & Birch, LLP

(57) ABSTRACT

A low ignition propensity wrapping paper includes a paper web and bands arranged on the web at predetermined intervals in a longitudinal direction of the web. These bands are formed by applying a combustion-inhibition liquid onto the web. The combustion-inhibiting liquid contains a solvent and a combustion inhibitor that is sodium alginate or pectin dissolved in the solvent. The solvent is treated water obtained by substantially removing at least calcium ions and magnesium ions from raw water of a water supply or a well.

9 Claims, 4 Drawing Sheets

LOW IGNITION PROPENSITY WRAPPING PAPER AND METHOD AND MACHINE OF MANUFACTURING SAME

This application is the Bypass Continuation of the International Application No. PCT/JP2009/069866, filed on Nov. 25, 2009 and the entirety of the above-identified application is expressly incorporated herein by reference.

TECHNICAL FIELD

The present invention relates to wrapping paper that gives a low ignition propensity to cigarettes, and a method and machine of manufacturing the same.

BACKGROUND ART

In recent years, there has been a development of a self-extinguishing cigarette with intent to reduce cigarette-related fires. This self-extinguishing cigarette includes smoking material such as shred tobacco, and paper wrapping the smoking material. The paper is made of a low ignition propensity wrapping paper (for example, see FIG. 2 of Patent Document 1).

To be specific, the low ignition propensity wrapping paper disclosed in Patent Document 1 includes a paper web and bands that are longitudinally arranged in the web at predetermined intervals. These bands are formed by applying a combustion-inhibition liquid onto the web. More specifically, the combustion-inhibiting liquid consists of an aqueous solution and a combustion inhibitor dissolved in this aqueous solution. A web applied with the combustion-inhibiting liquid is dried by a dryer to turn into a low ignition propensity wrapping paper.

A higher concentration of combustion inhibitor in the combustion-inhibiting liquid is better to give a desired low ignition propensity to cigarette paper, or wrapping paper. On the other hand, the higher the concentration of the combustion inhibitor is, the higher the viscosity of the combustion-inhibiting liquid is increased.

High concentration of the combustion-inhibiting liquid makes it difficult to apply the low ignition propensity liquid onto the web, and precludes the accurate band formation on the web. Under the circumstances, it is necessary to reduce the viscosity of the combustion-inhibiting liquid at the time of applying the low ignition propensity liquid onto the web.

The combustion-inhibiting liquid has properties in which its viscosity decreases along with the increase of its temperature. For example, therefore, the combustion-inhibiting liquid may be heated prior to the application of the combustion-inhibiting liquid. Patent Document 1 uses a combustion-inhibiting liquid containing combustion inhibitor of low concentration and repeatedly applies this thin combustion-inhibiting liquid onto web, giving a desired low ignition propensity to wrapping paper (FIG. 4 of Patent Document 1).

PRIOR ART DOCUMENT

Patent Document

[Patent Document 1] Kohyo No. 2004-512849

SUMMARY OF THE INVENTION

Problem to be Solved by the Invention

At the time of heating the combustion-inhibiting liquid, it is required to maintain a heated state of not only the supply source of the combustion-inhibiting liquid but also the entire supply path from the supply source to the web. This requires a heating apparatus for the supply source and path.

In Patent Document 1, the combustion-inhibiting liquid is applied onto the web in a repeated way, so that it is necessary to prepare as many pairs of a combustion-inhibiting liquid applicator and a dryer as the number of times of applications. For that reason, the manufacturing machine of a low ignition propensity wrapping paper in Patent Document 1 is of large-scale. After a pre-stage applicator applies the combustion-inhibiting liquid onto the web to form a liquid-applied area on the web, a post-stage applicator has to apply the combustion-inhibiting liquid so that the liquid is accurately overlaid on the liquid-applied area of the web. On this account, the application of the combustion-inhibiting liquid onto the web is not easy.

It is an object of the present invention, firstly, to provide a low ignition propensity wrapping paper that does not require a large-scale manufacturing apparatus, and secondarily, to provide a method and machine of manufacturing the low ignition propensity wrapping paper.

Means for Solving the Problem

In order to accomplish the object, the inventors conceived the present invention on the basis of the knowledge that a combustion-inhibiting liquid turns into gel as a result of a cross-linking reaction between mineral ions and combustion inhibitor in water, increasing the viscosity of the combustion-inhibiting liquid.

A low ignition propensity wrapping paper of the present invention includes a paper web and an area formed by applying a combustion-inhibiting liquid onto the web, for inhibiting the web from burning. The combustion-inhibiting liquid includes a solvent from which at least calcium and magnesium are removed and a combustion inhibitor dissolved in the solvent. In particular, the combustion inhibitor is sodium alginate or pectin.

The present invention further provides a method of manufacturing the above-mentioned low ignition propensity wrapping paper. The manufacturing method includes a preparation step of preparing a combustion-inhibiting liquid, and an application step of applying the combustion-inhibiting liquid onto a paper web and forming an area that inhibits the web from burning. The preparation step includes a obtaining process of obtaining raw water as a solvent from a water supply or well; a purification process of purifying the obtained water by removing mineral ions from the raw water, in which the mineral ions to be removed contains at least calcium ions and magnesium ions; and a dissolving process of dissolving in the treated water the combustion inhibitor serving as a solute and thus producing the combustion-inhibiting liquid.

Specifically, the purification process uses any one of an ion-exchange resin, an ion-exchange membrane, and a reverse osmotic membrane to remove the mineral ions from the raw water. Preferably, the purification process maintains the treated water at constant temperature.

Preferably, the application step applies the combustion-inhibiting liquid onto the web while circulating the combustion-inhibiting liquid between an application position at which the combustion-inhibiting liquid is applied onto the web and a tank containing the combustion-inhibiting liquid.

The present invention further provides a machine of manufacturing a low ignition propensity wrapping paper. The manufacturing machine comprises a travel path for a paper web; a supply tank containing a combustion-inhibiting liquid to be applied onto the web, the combustion-inhabiting liquid including a solvent from which at least calcium and magnesium are removed and a combustion inhibitor dissolved in the solvent; an applicator interposed in the travel path, for applying the combustion-inhibiting liquid supplied from the supply tank onto the web, and forming an area that inhibits the web from burning; and a dryer interposed in the travel path to be located downstream from the applicator, for drying the web applied with the combustion-inhibiting liquid, and producing a low ignition propensity wrapping paper.

Preferably, the applicator includes a circulation path circulating the combustion-inhibiting liquid between the application position at which the combustion-inhibiting liquid is applied onto the web and the supply tank.

Since the solvent of the combustion-inhibiting liquid does not contain at least calcium ions and magnesium ions, there will be no cross-linking reaction caused by these ions and the combustion inhibitor. It is then difficult for the combustion-inhibiting liquid to turn into gel, which prevents the increase of viscosity of the combustion-inhibiting liquid.

For that reason, even if the combustion inhibitor concentration in the combustion-inhibiting liquid is set high so that the low ignition propensity wrapping paper fully exerts its primary function after a one-time application of the combustion-inhibiting liquid onto the web, the application of the combustion-inhibiting liquid onto the web is easy since the viscosity of the combustion-inhibiting liquid is prevented from increasing. This allows using an ordinary applicator such as a gravure applicator to apply the combustion-inhibiting liquid onto the web in manufacturing the low ignition propensity wrapping paper.

Since the viscosity of the combustion-inhibiting liquid is prevented from increasing, the combustion inhibitor concentration in the combustion-inhibiting liquid is allowed to be further increased. In this case, the solvent in the combustion-inhibiting liquid decreases, which reduces load on the dryer.

Technical Advantage of the Invention

Concerning the manufacture of the low ignition propensity wrapping paper, the present invention simplifies the manufacturing method and machine, and is therefore capable of manufacturing the low ignition propensity wrapping paper without difficulty.

BEST MODE FOR CARRYING OUT THE INVENTION

Figure 1:
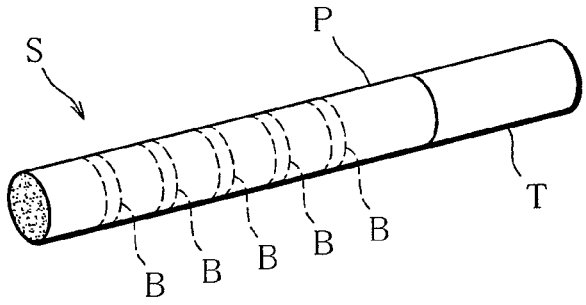
FIG. 1 is a perspective view of a self-extinguishing filter cigarette.

A self-extinguishing filter cigarette shown in FIG. 1 includes a cigarette S and a filter connected to one end of the cigarette S. The filter is connected to the cigarette S with a tip paper T. The cigarette S includes smoking material such as shred tobacco, and a low ignition propensity paper P wrapping the smoking material. The paper P gives a low ignition propensity to the cigarette S.

The paper P has a plurality of bands B. The bands B are formed by applying a low ignition propensity liquid onto a base material of the paper P, and then drying the base material. Specifically, the bands B are arranged at regular intervals in an axial direction of the cigarette S and extend around the entire circumference of the cigarette S.

Figure 2:
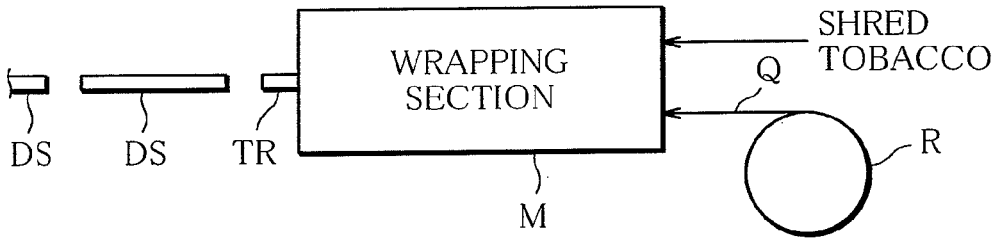
FIG. 2 is a schematic view for explaining the manufacture of the cigarette shown in FIG. 1.

FIG. 2 schematically shows a machine of manufacturing the cigarette S.

The manufacturing machine has a web roll R, which supplies a low ignition propensity wrapping paper Q serving as paper P towards a wrapping section M. The wrapping section M is further supplied with the smoking material. The wrapping section M wraps the smoking material in the wrapping paper Q and thus forms a tobacco rod TR in a continuous manner. The tobacco rod TR is then cut into predetermined length in a cutting section (not shown) and turn into double cigarettes DS, each being twice as long as the cigarette S.

The double cigarettes DS are supplied to a filter attaching machine, namely, a filter attachment (not shown). The filter attachment, as is well known, fabricates the filter cigarette of FIG. 1 from the double cigarette DS and a double filter.

Figure 3:
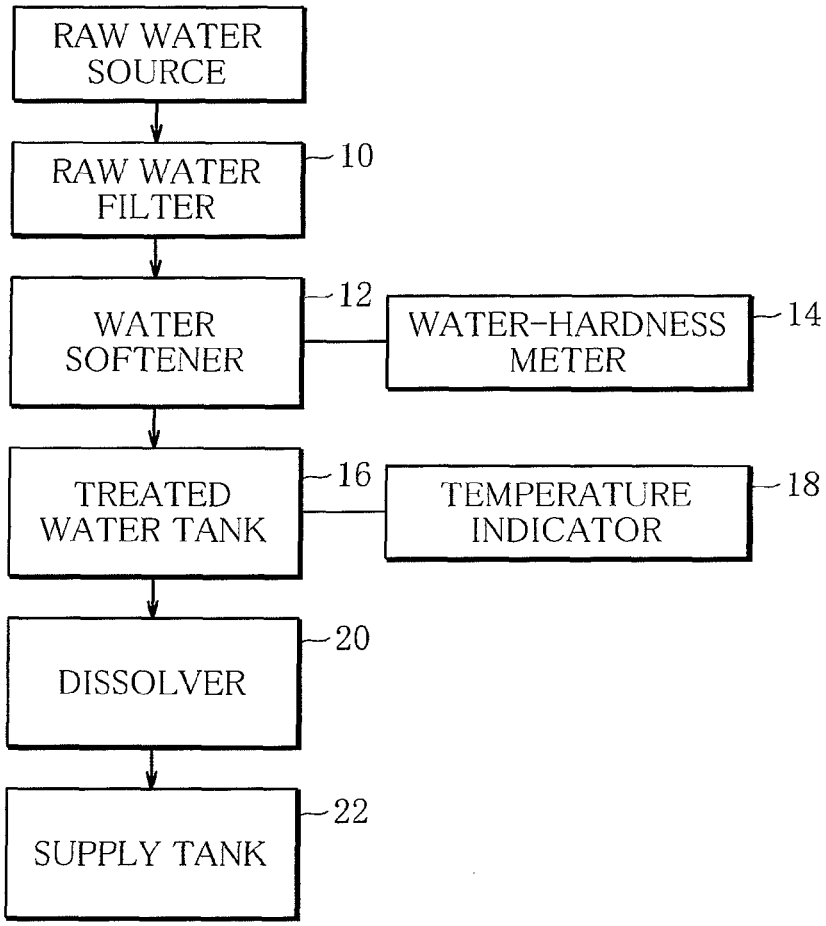
FIG. 3 is a block diagram for explaining the preparation of a combustion-inhibiting liquid used for the manufacture of a low ignition propensity wrapping paper shown in FIG. 1.

The preparation of the combustion-inhibiting liquid will be described below with reference to FIG. 3.

Firstly, raw water (at 13° C. to 17° C., for example) is obtained from a water supply or the raw water source of a well. The raw water passes through a raw water filter 10. The raw water filter 10 removes dust and the like from the raw water. The raw water is then supplied to a water softener 12, which includes ion-exchange resin. The ion-exchange resin produces treated water that is obtained by removing mineral ions including at least a calcium ion ($Ca^{2+}$), a magnesium ion ($Ma^{2+}$) and the like from the raw water.

The removal of mineral ions here does not mean removing all mineral ions from the treated water but reducing the concentration of mineral ions in the treated water to the degree where the treated water contains substantially no mineral ion. The mineral ion concentration in the treated water specifically ranges from 0 to 1 mg/l.

The water softener 12 has a function of monitoring the mineral ion concentration in the treated water. The water softener 12 further includes a water-hardness meter 14. The water-hardness meter 14 detects the water hardness (mineral ion concentration) of the treated water. The water softener 12 may use an ion-exchange membrane or a reverse osmotic membrane instead of the ion-exchange resin.

There is variation in mineral ion concentration in the raw water that is obtained from the water supply or the well, depending upon the raw water source. Regardless of the raw water source, however, the water softener 12 is capable of producing the treated water from which the mineral ions are substantially removed, that is, a solvent.

The treated water is subsequently supplied to a treated water tank 16 and temporarily stored in the treated water tank 16. The treated water tank 16 has a heater (not shown) and a temperature indicator 18. The heater and the temperature indicator 18 cooperate with each other to maintain the temperature of the treated water in the treated water tank 16 at constant temperature, for example, at 20° C.

The treated water in the treated water tank 16 is supplied to a dissolver 20. The dissolver 20 dissolves combustion inhibitor powder in the treated water to produce a combustion-inhibiting liquid. The combustion inhibitor here is sodium alginate or pectin.

The combustion-inhibiting liquid is supplied from the dissolver 20 to a supply tank 22, and stored in the supply tank 22.

TABLE 1 below shows the viscosities of combustion-inhibiting liquids of an embodiment and a comparative example. The combustion-inhibiting liquid of the comparative example directly uses raw water as a solvent for the combustion inhibitor. Combustion inhibitor concentrations in the combustion-inhibiting liquids of the embodiment and the comparative example are equal (4%, for example).

TABLE 1

| | Combustion inhibitor concentration | Viscosity (20° C.) |
|---|---|---|
| Embodiment (solvent: treated water) | 4.00% | 28800 cP |
| Comparative example (solvent: raw water) | 4.00% | 39300 cP |

As is apparent from TABLE 1, the viscosity of the combustion-inhibiting liquid of the embodiment is approximately 75% of the viscosity of the combustion-inhibiting liquid of the comparative example.

Figure 4:
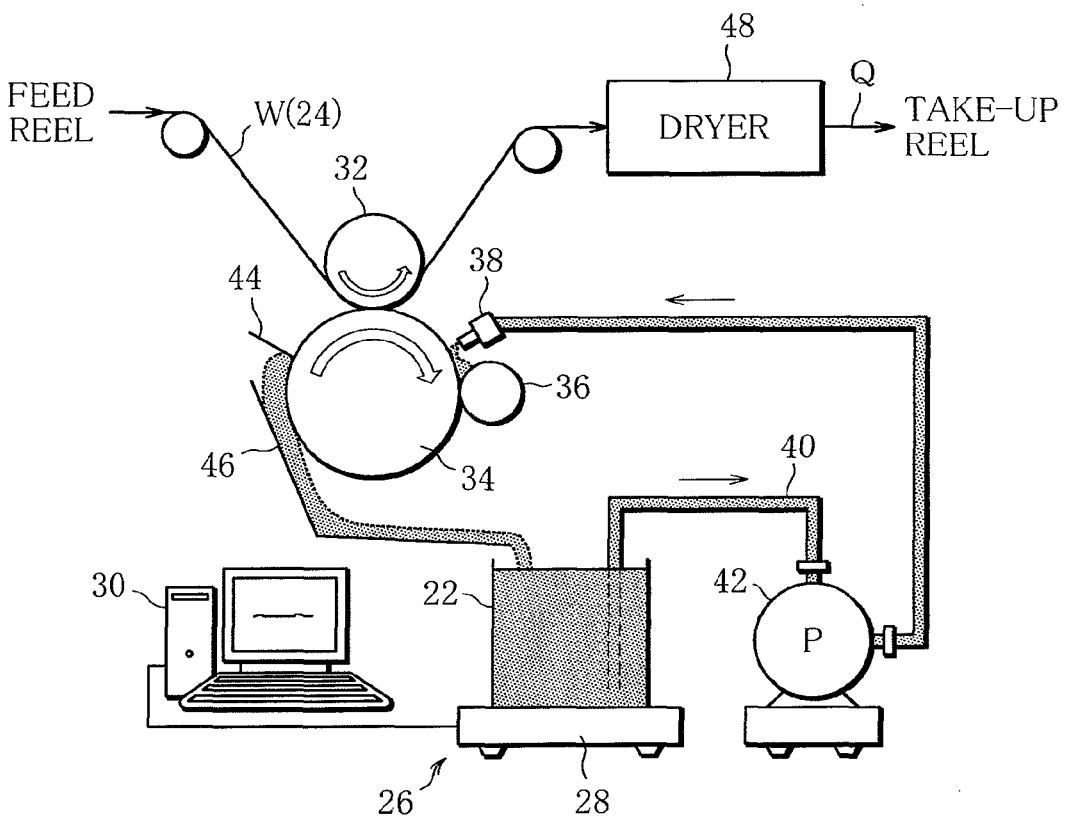
FIG. 4 is a schematic view of a manufacturing machine for manufacturing the low ignition propensity wrapping paper shown in FIG. 1.

FIG. 4 schematically shows the manufacturing machine. The manufacturing machine uses the combustion-inhibiting liquid of the embodiment to carryout a method of manufacturing the low ignition propensity wrapping paper Q from web W.

The manufacturing machine includes a travel path 24 for the web W. The travel path 24 extends from a feed reel of the web W towards a take-up reel. The web W reeled out from the feed reel travels along the travel path 24, and is taken up by the take-up reel, to thereby form the web roll R.

An applicator 26 is interposed in the travel path 24. The applicator 26 has the supply tank 22. The supply tank 22 contains the combustion-inhibiting liquid of the embodiment. According to the embodiment, the supply tank 22 is placed on a weight scale 28. The weight scale 28 detects the weight of the supply tank 22, that is, a remaining amount of the combustion-inhibiting liquid, and transmits a detection result to a monitoring system 30. The monitoring system includes a display and is capable of indicating on the display the remaining amount, or consumed amount, of the combustion-inhibiting liquid in the supply tank 22.

The applicator 26 further has a platen 32 and a gravure roller 34. The platen 32 and the gravure roller 34 are situated across the travel path 24, or across the web W. They are rotatable in opposite directions to each other. The gravure roller 34 is provided with a flute pattern (not shown) on an outer circumferential surface thereof. The flutes are arranged at predetermined intervals in a circumferential direction of the gravure roller 34 so as to form the bands B on the web W.

A furnisher roller 36 is in rotating contact with the outer circumferential surface of the gravure roller 34. A nozzle 38 is located above the furnisher roller 36. The nozzle 38 is connected to the supply tank 22 through a supply pipe 40. A capacity pump 42 is interposed in the supply pipe 40. While in operation, the pump 42 delivers the combustion-inhibiting liquid in the supply tank 22 through the supply pipe 40 to the nozzle 38. The nozzle 38 supplies the combustion-inhibiting liquid to between the gravure roller 34 and the furnisher roller 36.

A doctor blade 44 is located near the gravure roller 34. The doctor blade 44 has a tip end that is in sliding contact with the outer circumferential surface of the gravure roller 34. A recovery chute 46 is disposed under the gravure roller 34 and the doctor blade 44. The recovery chute 46 extends to the supply tank 22.

A dryer 48 is interposed in the travel path 24 to be located downstream from the platen 32 and the gravure roller 34. When the web W passes through the dryer 48, the dryer 48 dries the web W. According to the applicator 26, when the web W passes through between the platen 32 and the gravure roller 34, the gravure roller 34 applies the combustion-inhibiting liquid onto the web W according to the flute pattern.

Since the solvent of the combustion-inhibiting liquid of the embodiment, or the treated water, does not substantially contain the mineral ions, such as calcium ions and magnesium ions, as described above, it is possible to efficiently prevent the gelatinization of the combustion-inhibiting liquid, which is caused by a cross-linking reaction between the mineral ions and the combustion inhibitor. As a result, the combustion-inhibiting liquid in the supply tank 22 is prevented from increasing in viscosity, so that the viscosity of the combustion-inhibiting liquid is maintained low. This facilitates the application of the combustion-inhibiting liquid onto the web W by the gravure roller 34, and also facilitates the handling of the combustion-inhibiting liquid.

The doctor blade 44 scrapes extra combustion inhibitor off the outer circumstantial surface of the gravure roller 34. The combustion inhibitor scraped off is returned to the supply tank 22 via the recovery chute 46. In other words, during the operation of the manufacturing machine, the combustion-inhibiting liquid in the supply tank 22 circulates between an application position at which the combustion-inhibiting liquid is applied onto the web W (gravure roller 34) and the supply tank 22, and is in a constant flowing state. This further effectively prevents the gelatinization of the combustion-inhibiting liquid.

The web W applied with the combustion-inhibiting liquid passes through the dryer 48, and at this time, the dryer 48 dries the combustion-inhibiting liquid on the web W, to thereby form the bands B. Thereafter, the web W that has been dried, or the low ignition propensity wrapping paper Q, is taken up by the take-up reel, to thereby form the web roll R. The web roll R is mounted on the cigarette manufacturing machine and is used for the manufacture of the cigarette S.

Figure 5:
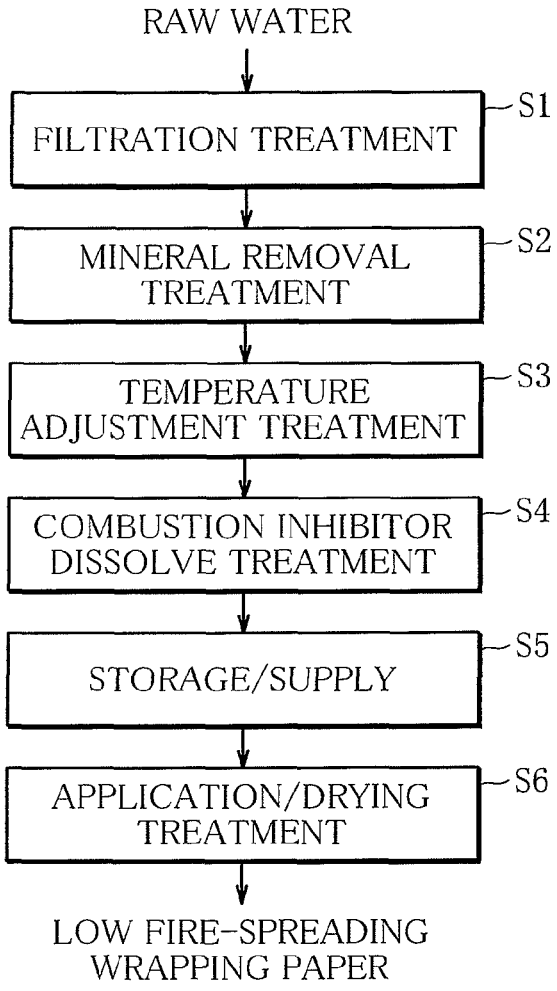
FIG. 5 is a flowchart showing a routine from the preparation of the combustion-inhibiting liquid to the manufacture of the low ignition propensity wrapping paper.

FIG. 5 shows a process from the preparation of the low ignition propensity liquid to the manufacture of the low ignition propensity wrapping paper Q.

The raw water is subjected to a filtration treatment (Step S1) and a mineral-ion removal treatment (Step S2) into treated water, subjected to a temperature adjustment treatment (Step S3) in the treated water tank 16, and maintained at constant temperature.

The combustion inhibitor powder is dissolved into the treated water (Step S4), thereby preparing the combustion-inhibiting liquid. The combustion-inhibiting liquid is stored in the supply tank 22 and supplied from the supply tank 22 to the gravure roller 34 of the applicator 26 (Step S5).

The application treatment of the combustion-inhibiting liquid at the gravure roller 34 and the drying treatment of the combustion-inhibiting liquid are carried out to the web W (Step S6). The low ignition propensity wrapping paper Q is thus obtained.

The present invention is not limited to the foregoing embodiment and may be modified in various ways.

For example, instead of the treated water, pure water containing no mineral ion may be used as the solvent of the combustion-inhibiting liquid. In this case, Steps S1 and S2 in FIG. 5 are omitted.

The present invention may use other combustion inhibitors than sodium alginate and pectin, and also may utilize various types of applicators instead of the applicator 26 shown in FIG. 5 to apply the combustion-inhibiting liquid onto the web W.

Furthermore, the applicator 26 and the dryer 48 may be disposed between the web roll R and the wrapping section M of the cigarette manufacturing machine shown in FIG. 2.

| Reference marks | |
|---|---|
| 12 | water softener (mineral ion removal) |
| 16 | treated water tank |
| 20 | dissolver |
| 22 | supply tank |
| 24 | travel path |
| 26 | applicator |
| 32 | platen |
| 34 | gravure roller |
| 36 | furnisher roller |
| 38 | nozzle |
| 40 | supply pipe (circulation path) |
| 42 | capacity pump |
| 44 | doctor blade |
| 46 | recovery chute |
| 48 | dryer |
| P | paper |
| Q | low ignition propensity wrapping paper |
| W | web |

The invention claimed is:

1. A low ignition propensity wrapping paper comprising:

a paper web; and an area formed by applying a combustion-inhibiting liquid onto said web, for inhibiting said web from burning, wherein:

said combustion-inhibiting liquid contains a solvent from which at least calcium ions and magnesium ions are removed and a combustion inhibitor dissolved in the solvent.

2. The low ignition propensity wrapping paper according to claim 1, wherein the combustion inhibitor includes sodium alginate or pectin.

3. A method of manufacturing a low ignition propensity wrapping paper, comprising:

a preparation step of preparing a combustion-inhibiting liquid; and an application step of applying said combustion-inhibiting liquid onto a paper web and forming an area for inhibiting the web from burning, wherein:

said preparation step includes a obtaining process of obtaining raw water as a solvent from a water supply or well;

a purification process of purifying the obtained water by removing mineral ions from the raw water and producing treated water, in which the mineral ions to be removed contains at least calcium ions and magnesium ions; and a dissolving process of dissolving in the treated water a combustion inhibitor serving as a solute and thus producing said combustion-inhibiting liquid.

4. The method of manufacturing a low ignition propensity wrapping paper according to claim 3, wherein said purification process uses any one of an ion-exchange resin, an ion-exchange membrane, and a reverse osmotic membrane to remove the mineral ions from the raw water.

5. The method of manufacturing a low ignition propensity wrapping paper according to claim 3, wherein said purification process maintains the treated water at constant temperature.

6. The method of manufacturing a low ignition propensity wrapping paper according to claim 3, wherein said application step applies said combustion-inhibiting liquid onto the web while circulating said combustion-inhibiting liquid between an application position at which said combustion-inhibiting liquid is applied onto the web and a tank containing said combustion-inhibiting liquid.

7. A machine of manufacturing a low ignition propensity wrapping paper, comprising:

a travel path for a paper web;

a supply tank containing a combustion-inhibiting liquid to be applied onto the web, said combustion-inhabiting liquid including a solvent from which at least calcium and magnesium are removed and a combustion inhibitor dissolved in the solvent;

an applicator interposed in the travel path, for applying said combustion-inhibiting liquid supplied from the supply tank onto the web, and forming an area that inhibits the web from burning; and a dryer interposed in the travel path to be located downstream from said applicator, for drying the web applied with said combustion-inhibiting liquid, and producing a low ignition propensity wrapping paper.

8. The machine of manufacturing a low ignition propensity wrapping paper according to claim 7, wherein the combustion inhibitor includes sodium alginate or pectin.

9. The machine of manufacturing a low ignition propensity wrapping paper according to claim 7, wherein said applicator includes a circulation path circulating said combustion-inhibiting liquid between the application position at which said combustion-inhibiting liquid is applied onto the web and said supply tank.

* * * * *